United States Patent [19]

Lipari

[11] 3,980,805

[45] Sept. 14, 1976

[54] QUICK RELEASE SLEEVE FASTENER

[75] Inventor: Dominic Timothy Lipari, Reynoldsburg, Ohio

[73] Assignee: Bell Telephone Laboratories, Incorporated, Murray Hill, N.J.

[22] Filed: Mar. 31, 1975

[21] Appl. No.: 563,617

[52] U.S. Cl. ..... 174/88 C; 285/321; 403/378

[51] Int. Cl.[2] ..... H01R 5/02

[58] Field of Search ..... 174/68 C, 75 C, 88 C, 174/88 S, 88 R, 84 S, 84 R; 403/378, 377, 376; 285/321, 404; 339/138–140, 206 R, 207 R, 207 S, 209, 75 R, 75 M

[56] References Cited

UNITED STATES PATENTS

| | | | |
|---|---|---|---|
| 2,110,397 | 3/1938 | Kangas | 403/378 X |
| 2,138,843 | 12/1938 | Dupuis | 403/378 X |
| 2,484,401 | 10/1949 | Cole | 403/379 X |
| 3,207,535 | 9/1965 | Wilson | 285/321 X |
| 3,502,788 | 3/1970 | Albert | 174/88 C |

*Primary Examiner*—Laramie E. Askin
*Attorney, Agent, or Firm*—W. H. Kamstra

[57] ABSTRACT

Electrical interconnection apparatus for coaxial cable and the like comprising a shielding sleeve removably slipped about, and covering access ports in, a tubular conductor featuring a snap-on retaining clip. An inwardly extending pin on the inner surface of the clip is inserted in aligned apertures in the sleeve and conductor to secure the sleeve in place. The clip is readily pried off to permit moving aside the sleeve for access through the ports to solder joints, for example.

3 Claims, 1 Drawing Figure

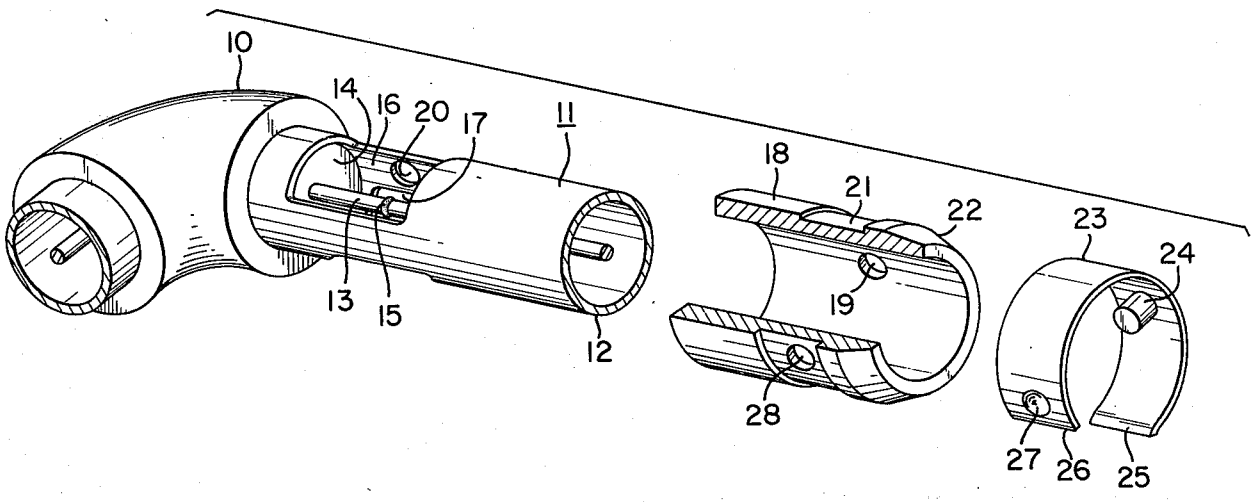
10
11
12
13
14
15
16
17
18
19
20
21
22
23
24
25
26
27
28

QUICK RELEASE SLEEVE FASTENER

BACKGROUND OF THE INVENTION

This invention relates to electrical line interconnections and more particularly to apparatus for interconnecting coaxial transmission lines.

Coaxial transmission lines for transmitting high frequency signals are well-known in the communications art and have found wide application in the fields of radio and television, for example. These conductor cables take the form of a center conductor mounted inside of, and coaxial with, an outer metallic tubing and separated therefrom by spaced insulators. At junction points such as at 90° bends, for example, the tubing is soldered to a coaxial elbow, the inner conductor of the cable being soldered to a corresponding inner conductor of the elbow. The manner of making the solder connection of the outer conductor and its subsequent periodic inspections for electrical continuity are readily envisioned. The soldering of the inner conductors, which are fixed inside the coaxial tubes, on the other hand, presents the problem of access, both initially at the time of the soldering step and for subsequent periodic inspections. Such access is normally achieved by providing a pair of opposing ports in the outer conductor at the junction point of the inner conductors. In order to prevent energy loss at the ports, a covering sleeve is then slip fitted about the outer conductor to cover the ports. In the past, this covering sleeve has been maintained in position by a set screw to permit its ready removal for the purpose of inspecting the solder joint of the inner conductors.

Although apparently a simple expedient for securing the covering sleeve, the set screw has long presented an irritating problem in that it is frequently dropped and lost and, after a few removals, must also frequently be replaced because of stripped threads. Although the expense of such set screw replacement is not prohibitive, it is time-consuming especially when a replacement screw is not immediately available. The problem, of course, is aggravated if the threads in the sleeve itself are stripped.

It is accordingly an object of this invention to provide a new and novel means for securing a coaxial cable inspection sleeve.

It is also an object of this invention to provide a new and novel locking means for removably securing an outer sleeve fitted on an inner tubing.

A further object of this invention is the realization of an improved coaxial cable joint assembly.

SUMMARY OF THE INVENTION

The foregoing objects of this invention are realized in one illustrative embodiment thereof comprising a flat circular spring clip adapted to encircle the outer protective sleeve slipped over a coaxial outer tube conductor at a junction point. The sleeve is intended to provide high frequency shielding at two ports in the outer conductor provided to permit initial access for joint soldering and to permit subsequent inspection of the solder joint of the inner conductor. Specifically, the clip encircles the outer sleeve shield in snap-on fashion to permit a pin affixed to the inner surface of the clip to enter aligned apertures in both the sleeve shield and the conductor tubing. The clip is readily pried off the sleeve shield, a slight protrusion on the inner surface of one end of the clip engaging a dimple or indentation in the shield to prevent rotation during removal. Advantageously, the sleeve shield may be milled to provide a seat for the spring clip to present a smooth outer surface.

One feature of this invention is thus a novel spring clip arangement which, while clasping a shielding sleeve of a coaxial cable assembly, maintains a pin in aligned apertures of the latter sleeve and a coaxial outer conductor.

BRIEF DESCRIPTION OF THE DRAWING

The foregoing and other objects and features of this invention will be better understood from a detailed description of the organization and operation of one illustrative embodiment thereof when taken in conjunction with the accompanying drawing the single FIGURE of which depicts in exploded view the relationship of the elements of a typical coaxial cable joint assembly and the novel spring clip of this invention, portions of particular elements being broken to reveal structural aspects.

DETAILED DESCRIPTION

In the single FIGURE of the drawing is shown in exploded view a typical coaxial cable junction point comprising a 90° elbow 10 having soldered therein a section of coaxial cable 11. The latter comprises an outer tubular conductor 12 having coaxially fitted inside an inner conductor 13 which is rigidly maintained by insulators such as the insulator 14. The conductor 13 comprises an extension from the elbow element 10 connected to the inner conductor of the cable 11 by means of a solder joint 15. Opposing ports 16 and 17 are provided in the outer conductor 12 in order to provide initial access for making the solder joint 15 and for making subsequent periodic inspections of the latter joint.

In order to prevent energy loss through the ports 16 and 17 during the operation of the cable after a particular transmission installation, a shielding sleeve 18 is provided which is adapted and dimensioned to be slip fitted about the outer conductor 12 to cover the ports 16 and 17. The sleeve 18 is also adapted to be slid from its shielding position to permit inspection of the solder joint 15 or, for that matter, the opening of the joint to disconnect the cable from the elbow. The sleeve 18 is shown with a portion broken away better to reveal a circular aperture 19 drilled through one side of the shield. The aperture 19 is located to align with a corresponding circular aperture 20 of substantially the same diameter drilled in one side of the outer conductor 12 between the access ports 16 and 17 when the sleeve 18 is slid into its shielding position. The sleeve 18 may be further formed to present a milled annular slot or channel 21 to seat the final element of the assembly. The sleeve 18 is typically chamfered at one end to present a tapered end 22.

When the sleeve 18 is slid along the outer conductor 12 into position over the ports 16 and 17, a tempered circular spring clip 23, open at one side, is adapted to be sprung about the sleeve 18 into the annular slot 21 provided therefor. As a result, a pin 24 affixed to the closed side of the clip 23 and radially extending inwardly therefrom, is adapted and dimensioned for insertion into the aligned apertures 19 and 20 of the sleeve 18 and outer conductor 12, respectively. The flat spring clip 23 is tempered to be firmly seated in the annular slot 21 with the result that the sleeve 18 is positively secured in position about the conductor 12 by the pin 24. The clip 23, at an end 25 at its open side, may advantageously be slightly rolled to facilitate removal by prying. To prevent any rotation during removal, the clip 23 has provided at another end 26 at its open side an inwardly directed protrusion 27 which may conventionally be stamped in the clip material for seating in a mating indentation or aperture 28 in sleeve 18. Indentation or aperture 28 and aperture 19 may be spaced 180° apart on the sleeve 18 to facilitate the seating of spring clip 23 and its removal.

What has been described is considered to be only one specific embodiment of this invention and it is to be understood that various and numerous other arrangements may be devised by one skilled in the art without departing from the spirit and scope of the invention as defined by the appended claims. Thus, it will be appreciated that the novel spring clip may perform other retaining functions in the electrical transmission art and it is obviously applicable to interconnections other than the 90° elbow joint described merely by way of example. The clip could be employed to replace the set screw which frequently maintains in place the insulating sleeve of a telephone switchboard operator's jack, to name another example.

What is claimed is

1. An electrical connector assembly comprising an outer tubular conductor, an inner conductor coaxial within said outer conductor, said outer conductor having at least one port for permitting access to said inner conductor and a first aperture, a shielding sleeve slidably positioned about said outer conductor over said port, said sleeve having a second aperture aligned with said first aperture, and means for removably securing said shielding sleeve comprising an open-sided spring clip encircling said sleeve, said clip having a substantially inwardly directed pin means at its closed side fitted in said aligned first and second apertures, said sleeve also having at least an indentation formed therein substantially in circumferential alignment with said first aperture, said clip having provided at one of its open ends an inwardly directed protrusion engaging said indentation.

2. An electrical connector assembly as claimed in claim 1 in which said spring clip has the other of its open ends slightly rolled outwardly to facilitate a pried removal.

3. An electrical connector assembly as claimed in claim 2 in which said sleeve is formed to present an annular slot seating said spring clip.

* * * * *